US010519626B2

(12) United States Patent
Walenta et al.

(10) Patent No.: US 10,519,626 B2
(45) Date of Patent: Dec. 31, 2019

(54) SYSTEM AND METHOD FOR CONTROLLING MACHINE

(71) Applicant: Caterpillar Inc., Peoria, IL (US)

(72) Inventors: Clayton Delaney Walenta, Peoria, IL (US); SriVidya Lavanya Kamisetty, Brookfield, WI (US); Michael Ivan Portscheller, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 203 days.

(21) Appl. No.: 15/815,007

(22) Filed: Nov. 16, 2017

(65) Prior Publication Data

US 2019/0145082 A1 May 16, 2019

(51) Int. Cl.

| | |
|---|---|
| ***A01B 63/00*** | (2006.01) |
| ***E02F 9/12*** | (2006.01) |
| *E02F 9/26* | (2006.01) |
| *E02F 9/22* | (2006.01) |

(52) U.S. Cl.

CPC ..... *E02F 9/123* (2013.01); *E02F 9/2221* (2013.01); *E02F 9/265* (2013.01)

(58) Field of Classification Search

USPC ..... 701/50

See application file for complete search history.

(56) References Cited

U.S. PATENT DOCUMENTS

| | | | | |
|---|---|---|---|---|
| 7,795,752 | B2 * | 9/2010 | Gorman | H02J 1/14 307/9.1 |
| 8,190,334 | B2 * | 5/2012 | Kagoshima | E02F 9/123 701/50 |
| 8,666,613 | B2 * | 3/2014 | Choi | E02F 9/123 180/336 |
| 8,793,002 | B2 | 7/2014 | Anderson et al. | |
| 8,818,649 | B2 * | 8/2014 | Udagawa | E02F 9/123 701/50 |
| 9,008,919 | B2 * | 4/2015 | Lee | E02F 9/2033 172/2 |
| 2008/0164832 | A1 * | 7/2008 | Kawaguchi | E02F 9/123 318/456 |
| 2011/0029206 | A1 * | 2/2011 | Kang | E02F 9/123 701/50 |
| 2013/0111888 | A1 | 5/2013 | Schwab et al. | |
| 2014/0208728 | A1 | 7/2014 | Ma et al. | |

* cited by examiner

*Primary Examiner* — Masud Ahmed

(57) ABSTRACT

A method for controlling a machine. The machine includes a swing system and a plurality of systems. The method comprises generating, by an inertial measurement unit, data pertaining to rotation of an upper carriage of the machine relative to a work surface, determining, by a controller, data pertaining to rotation of the upper carriage relative to an undercarriage of the machine based on the data generated by the inertial measurement unit. The method includes determining, by the controller, an amount of torque received by the swing system from a power source based on the data pertaining to the rotation of the upper carriage relative to the undercarriage, determining, by the controller, a total torque demand based on the first amount of torque and adjusting, by the controller, the total torque demand when the total torque demand exceeds a maximum torque capacity of the power source.

17 Claims, 6 Drawing Sheets

SYSTEM AND METHOD FOR CONTROLLING MACHINE

TECHNICAL FIELD

The present disclosure generally relates to a machine. More particularly, the present disclosure relates to systems and methods for controlling operation of the machine.

BACKGROUND

Swing-type excavation machines, for example hydraulic excavators and front shovels, may be used for transferring material from a dig location to a dump location. These machines generally utilize one or more systems (consuming torque from a power source of the machine), requiring significant hydraulic pressure and flow for performing various operations (the one or more systems including an implement system, a swing system, etc.). For instance, the swing system may include power source-driven swing pump passing pressurized fluid through a swing motor to rotate an upper carriage of the machine relative to an undercarriage of the machine.

Such machines also include a control system that may be configured to determine the torques consumed (or drawn from the power source) by each of the one or more systems to efficiently control operation of the machine and/or the one or more systems of the machine. For certain systems, it may be possible to accurately determine the torque received from the engine. However, it may not be possible to accurately determine the torque consumed by the swing system.

In such situations, the control system may predict/estimate a value of torque consumed by the swing system. The prediction/estimation may not yield an accurate value of torque being consumed by the swing system. Accordingly, the control system may not able to accurately determine a total torque demand, which may lead to inefficient operation of the machine. Further, due to the inaccurate torque determination, in certain scenarios, the condition when the total torque demand exceeds the maximum torque that can be generated by the power source may not be detected. In such situations, the power source may stall.

U.S. patent application publication number 20130111888A1 discloses a hydraulic circuit. The hydraulic circuit includes a hydraulic swing motor having a first port and a second port. A first motor conduit is connected to the first port of the hydraulic swing motor, and a second motor conduit is connected to the second port of the hydraulic swing motor. The hydraulic circuit further includes a pump to selectively supply a flow of pressurized hydraulic fluid to the hydraulic swing motor through the first and the second motor conduits. A controller is electrically connected to the pump to adjust a torque output of the pump based on a swing speed of the hydraulic swing motor.

SUMMARY OF THE INVENTION

In an aspect of the present disclosure, a method for controlling a machine is disclosed. The machine includes a swing system and a plurality of systems. The method comprises generating, by an inertial measurement unit, data pertaining to a rotation of an upper carriage of the machine relative to a work surface. The method further includes determining, by a controller, data pertaining to a rotation of the upper carriage relative to an undercarriage of the machine based on the data generated by the inertial measurement unit, wherein the swing system performs the rotation of the upper carriage relative to the undercarriage. The method also includes determining, by the controller, an amount of torque consumed by the swing system. The amount of torque is determined based on the data pertaining to the rotation of the upper carriage relative to the undercarriage and the swing system receives the amount of torque from a power source of the machine. The method then includes determining, by the controller, a total torque demand based on the amount of torque and adjusting, by the controller, the total torque demand when the total torque demand exceeds a maximum torque capacity of the power source, by at least partially wherein adjusting the total torque demand includes reducing a particular amount of torque to be received from the power source by one or more systems of the plurality of systems.

In an aspect of the present disclosure, a control system for controlling a swing system and a plurality of systems operatively coupled to a power source of a machine is disclosed. The control system includes an inertial measurement unit and a controller. The inertial measurement unit is configured to determine data pertaining to a rotation of an upper carriage of the machine relative to a work surface. The controller is communicably coupled to the swing system, the plurality of systems and the inertial measurement unit. The controller is configured to determine data pertaining to a rotation of the upper carriage relative to an undercarriage of the machine based on the data generated by the inertial measurement unit. The swing system performs the rotation of the upper carriage relative to the undercarriage. The controller is further configured to determine an amount of torque consumed by the swing system. The amount of torque is determined based on the data pertaining to the rotation of the upper carriage relative to the undercarriage. The swing system receives the amount of torque from a power source of the machine. The controller is further configured to determine a total torque demand based on the amount of torque and adjust the total torque demand, when the total torque demand exceeds a maximum torque capacity of the power source, by reducing a particular amount of torque to be received from the power source by one or more systems of the plurality of systems.

In an aspect of the present disclosure, a machine is disclosed. The machine includes a power source, an undercarriage, an upper carriage, a plurality of systems, a swing system, an inertial measurement unit and a controller. The upper carriage is rotatably mounted on the undercarriage. The plurality of systems and the swing system are operatively coupled to the power source. The swing system is configured to rotate the upper carriage relative to the undercarriage. The inertial measurement unit is configured to determine data pertaining to a rotation of the upper carriage relative to a work surface. The controller is communicably coupled to the swing system, the plurality of systems and the inertial measurement unit. The controller is configured to determine data pertaining to a rotation of the upper carriage relative to the undercarriage of the machine based on the data generated by the inertial measurement unit. The controller is further configured to determine an amount of torque consumed by the swing system. The amount of torque is determined based on the data pertaining to the rotation of the upper carriage relative to the undercarriage. The swing system receives the amount of torque from a power source of the machine. The controller is also configured to determine a total torque demand based on the amount of torque. The controller is further configured to adjust the total torque demand, when the total torque demand exceeds a maximum torque capacity of the power source, by reducing a particular amount of torque to be received from the power source by one or more systems of the plurality of systems.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

Figure 1:
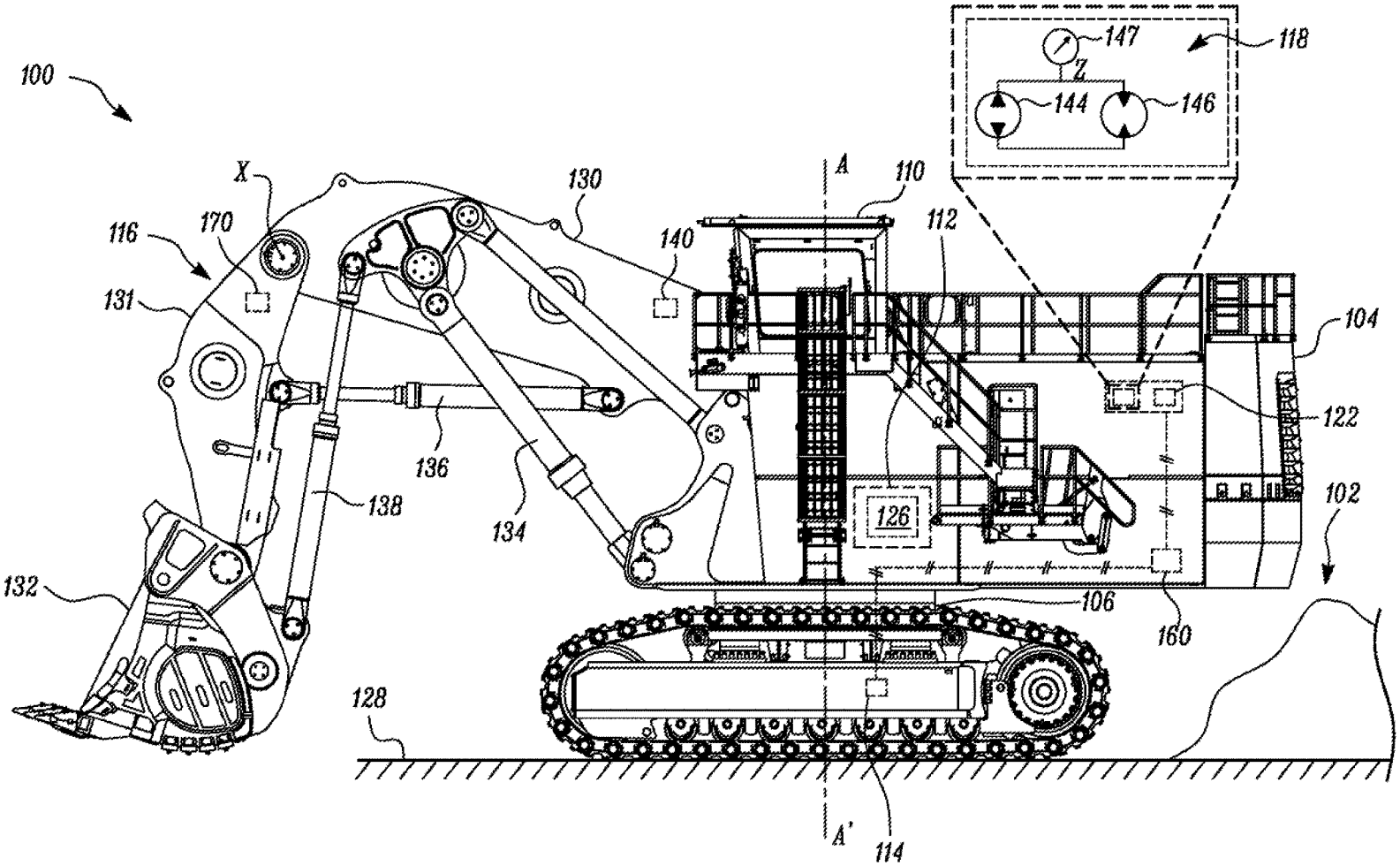
FIG. 1 is a diagrammatic illustration of an exemplary machine having an upper carriage and an undercarriage, in accordance with an embodiment of the present disclosure.

Referring now to FIG. 1, an exemplary machine 100 operating at a worksite 102 is illustrated. The worksite 102 may include, for example, a mine site, a landfill, a quarry, a construction site, or any other type of worksite. In the embodiment illustrated in FIG. 1, the machine 100 is a hydraulic mining shovel configured to remove/dig material from one location of the worksite 102 and to dump the collected material at another location on the worksite 102. However, in various other embodiments the machine 100 may be any machine configured to perform one of a dozing operation, a grading operation, a leveling operation, a bulk material removal operation, and/or any other type of operation that results in modifications within the worksite 102. In some embodiments, the machine 100 may be a machine having various levels of autonomy, such as a fully autonomous machine, a semi-autonomous machine, and/or a remotely operated machine. The machine 100 may be used to perform operations associated with industries related to mining, construction, farming, and/or the like.

Figure 2:
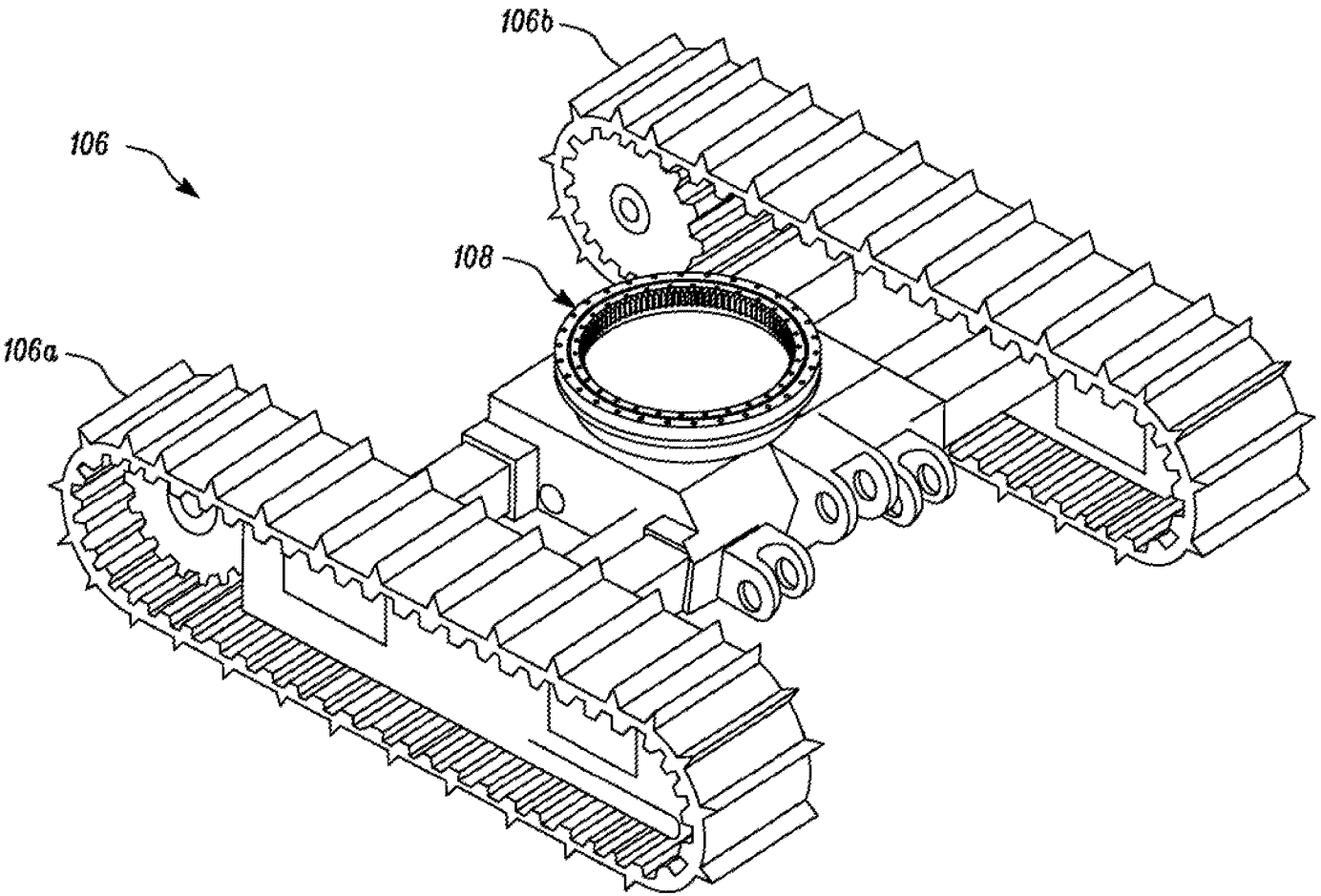
FIG. 2 is a diagrammatic illustration of the undercarriage of the machine, in accordance with an embodiment of the present disclosure.

The machine 100 includes an upper carriage 104 and an undercarriage 106. The undercarriage 106 may be a track frame that includes a pair of ground engaging track assemblies 106*a* and 106*b* (as shown in FIG. 2). The pair of ground engaging assemblies 106*a* and 106*b* may be configured to engage with a work surface 128 of the worksite 102. The upper carriage 104 is rotatably mounted on the undercarriage 106 such that the upper carriage 104 is configured to rotate relative to the undercarriage 106 about an axis A-A'. The upper carriage 104 may be rotatably mounted on the undercarriage 106 of the machine 100 via use of a swing assembly 108 provided on the undercarriage 106 (as shown in FIG. 2).

The upper carriage 104 may be configured to support various components/systems of the machine 100 such as an operator cab 110, a power producing system 112, an implement system 116, a swing system 118 and one or more auxiliary systems 122.

In the embodiment illustrated, the operator cab 110 is an enclosure that may include one or more of electronic panels, displays, buttons, joysticks and/or various other physically actuable components configured to move one or more of the systems of the machine 100.

The power producing system 112 includes a power source 126 in the form of an engine and/or an electric motor configured to produce torque to operate various systems of the machine 100. In an embodiment, the power source 126 may be a diesel engine. In various other embodiments, the power source 126 may be any engine running on solid, liquid or gaseous fuel. While one power source 126 has been illustrated in FIG. 1, in various other embodiments, the machine 100 may include a plurality of power sources 126 configured to produce torque for operating various systems of the machine 100.

The machine 100 may also include a propulsion system 114 provided on the undercarriage 106. The propulsion system 114 may be operatively coupled to the power source 126. The propulsion system 114 may include motors, transmission shafts, gears, differential systems, axles, idler wheels, and the like coupled to the ground engaging track assemblies 106*a* and 106*b*. Such components of the propulsion system 114 may be configured to receive some amount of torque from the power-source 126 to move the ground engaging track assemblies 106*a* and 106*b* on the work surface 128.

The implement system 116 includes a boom 130, a stick 131, a work implement 132 and hydraulic actuators 134, 136 and 138. An end of the boom 130 may be coupled to the upper carriage 104, while the other end of the boom 130 may be coupled to one end of the stick 131. An other end of the stick 131 may be coupled to the work implement 132. The stick 131 and/or boom 130 may be operated via the hydraulic actuators 134 and 136. The hydraulic actuator 136 may be configured to move the stick 131 about pivot point X. The work implement 132 may be operated by the hydraulic actuator 138. While the work implement 132 is embodied in the form of a bucket in FIG. 1, in some embodiments, other types of work implements (such as, but not limited to, blades, scrapers and/or the like) may be employed by the machine 100 without deviating from the spirit of the present disclosure.

The implement system 116 further includes to implement pump 140 operatively coupled to the power source 126. The implement system 116 may be configured to receive/use some amount of torque from the power source 126 and pressurize fluid stored in a reservoir/accumulator (not shown). This pressurized fluid may be utilized by the hydraulic actuators 134, 136 and 138 to move the boom 130, stick 131 and/or the work implement 132. While one implement pump 140 has been illustrated in FIG. 1, in some embodiments, the machine 100 may include a plurality of implement pumps 140.

Figure 3:
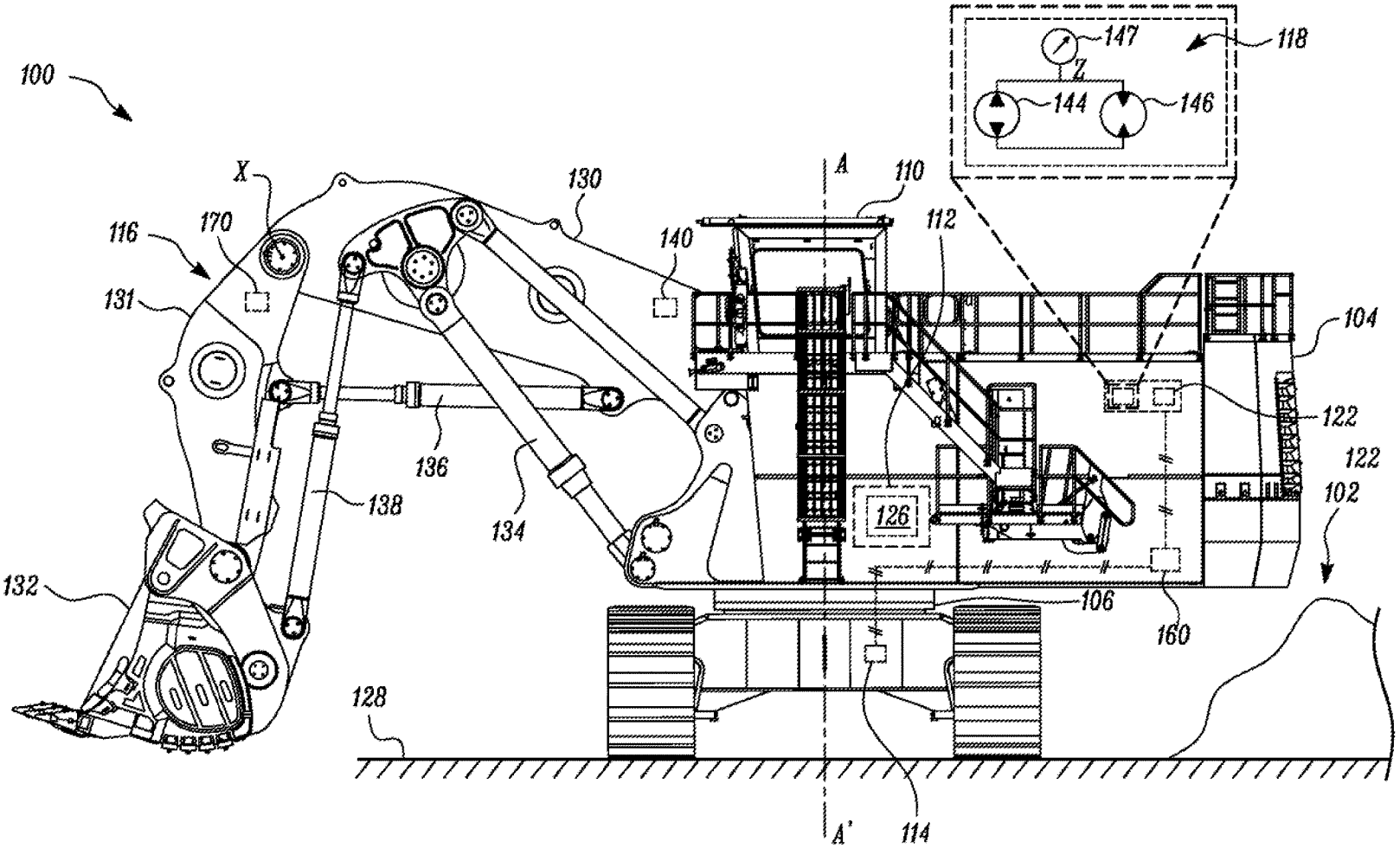
FIG. 3 is a diagrammatic illustration of the machine having the upper carriage at an angular orientation that is different to the orientation of the upper carriage illustrated in FIG. 4, in accordance with an embodiment of the present disclosure.

FIG. 1 illustrates the upper carriage 104 at a first angular position relative to the undercarriage 106 and FIG. 3 illustrates the upper carriage 104 at a second angular position relative to the undercarriage 106. Such rotation may be performed by the swing system 118 of the machine 100. The swing system 118 may include a swing pump 144, a swing motor 146 and a pressure measuring device 147. The swing pump 144 may be operatively coupled to the power source 126 and may be configured to receive some amount of torque from the power source 126 to pressurize fluid stored in a reservoir/accumulator. The pressurized fluid is made to pass through the swing motor 146 and generate a power. This power is utilized to rotate the upper carriage 104 relative to the undercarriage 106. The pressure measuring device 147 may be configured to detect the pressure of the fluid flowing within the swing system 118 at one or more locations in the swing system 118 (for example, the pressure measuring device 147 may detect pressures at Point Z of the swing system 118). While only one swing pump 144, swing motor 146 and pressure measuring device 147 have been illustrated, in some embodiments, the machine 100 may include a plurality of swing pumps 144, a plurality of swing motors 146, and/or a plurality of pressure measuring devices 147.

The machine 100 includes the one or more auxiliary systems 122. The one or more auxiliary systems 122 may include a display, a fan for ventilation, one or more cooling fans, air conditioning unit, lighting system, servo system, gearbox cooling system, and/or the like. The one or more auxiliary systems 122 may be operatively coupled to the power source 126 and may be configured to receive some amount of torque from the power source 126 to operate the display, fan for ventilation, one or more cooling fans, air conditioning unit, lighting system, servo system, gearbox cooling system and/or the like.

While a few systems of the machine 100 have been presented in the embodiment illustrated, in other embodiments the machine 100 may further include various other systems that may receive some amount of torque from the power source 126 for performing a specific operation/function.

Figure 4:
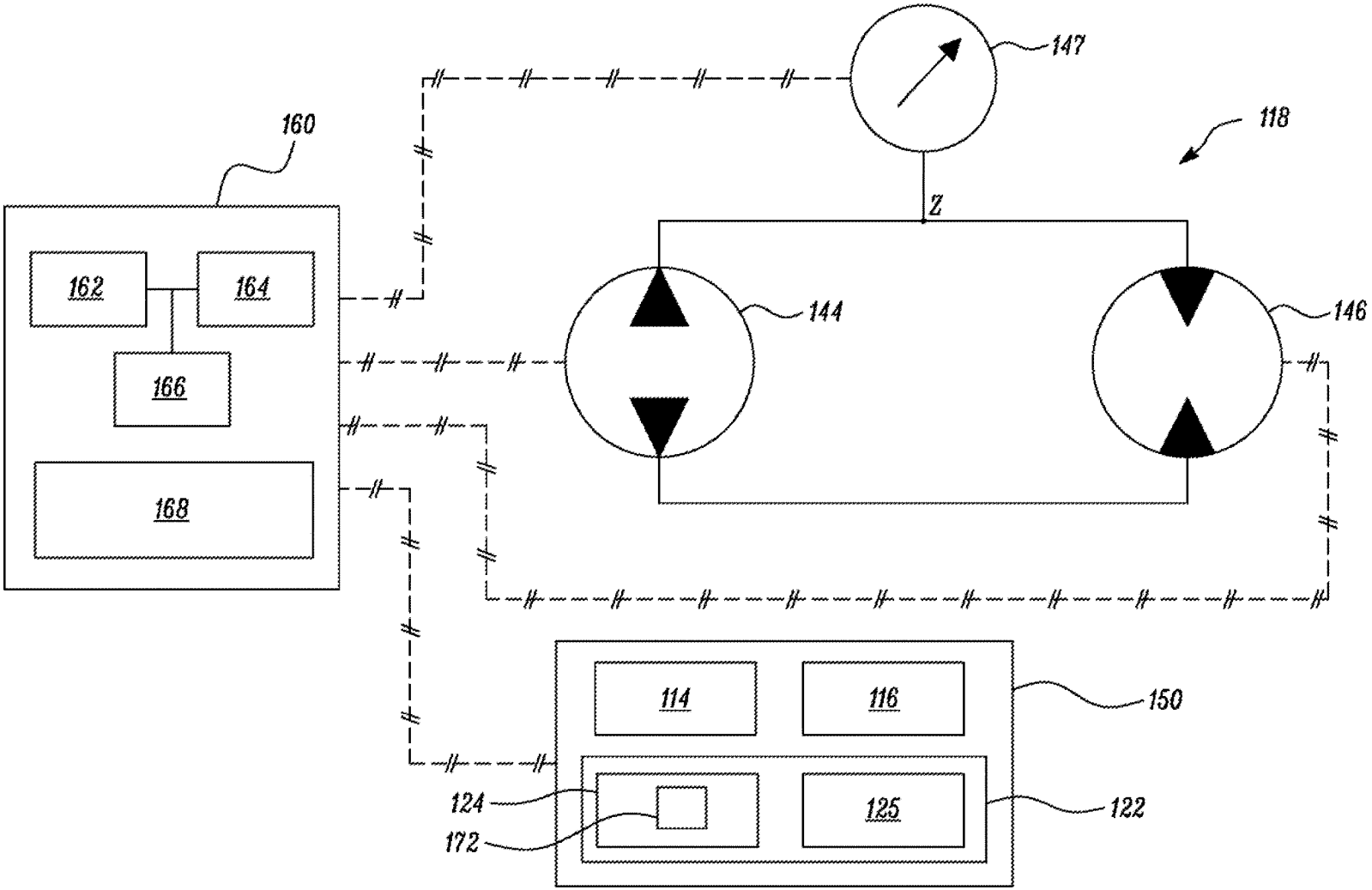
FIG. 4 illustrates a schematic of the one or more systems of the machine, in accordance with an embodiment of the present disclosure.

For the purpose of better undemanding of the current disclosure, hereinafter it shall be assumed that the machine 100 includes the swing system 118 and a plurality of systems referred by the reference numeral 150, as illustrated in FIG. 4. The plurality of systems 150 include the propulsion system 114, implement system 116, and one or more auxiliary systems 122.

The machine 100 further includes a control system 160 that may be configured to determine amount of torques consumed (i.e., torque received from the power source 126) by each system (i.e., the swing system 118 and the plurality of systems 150 of the machine 100). Further, the control system 160 may be configured to efficiently control operation of the machine 100 based on the determination of the amount of torques. The control system 160 includes a controller 162, a memory 164, and a communication device 166.

The controller 162 may also be configured to operate according to one or more instructions. The controller 162 may include any one or more of a processor, a microprocessor, a microcontroller, or any other suitable means for executing instructions/computations. The instructions may be retrievably stored within the memory 164. The memory 164 may be provided on-board the controller 162 or external to the controller 162. The memory 164 may include non-transitory computer-readable medium or memory, such as a disc drive, flash drive, optical memory, read-only memory (ROM), or the like.

The controller 162 may be operably coupled to the communication device 166. The communication device 166 facilitates communication with the machine 100 and/or the swing system 118, the pressure measuring device 147 and the plurality of systems 150. The communication device 166 may be a transceiver (i.e., a device comprising both a transmitter and a receiver that are combined and share common circuitry or a single housing. When no circuitry is common between transmit and receive functions, the device is a transmitter-receiver). The transceiver may utilize one or more known communication protocols to transmit and receive data from the components and one or more computing devices. Examples of such communication protocols may include, but are not limited to, Transport Control Protocol/Internet Protocol (TCP/IP), 3G, 4G, 2G, Bluetooth, Zigbee, I2C, and/or the like.

Figure 5:
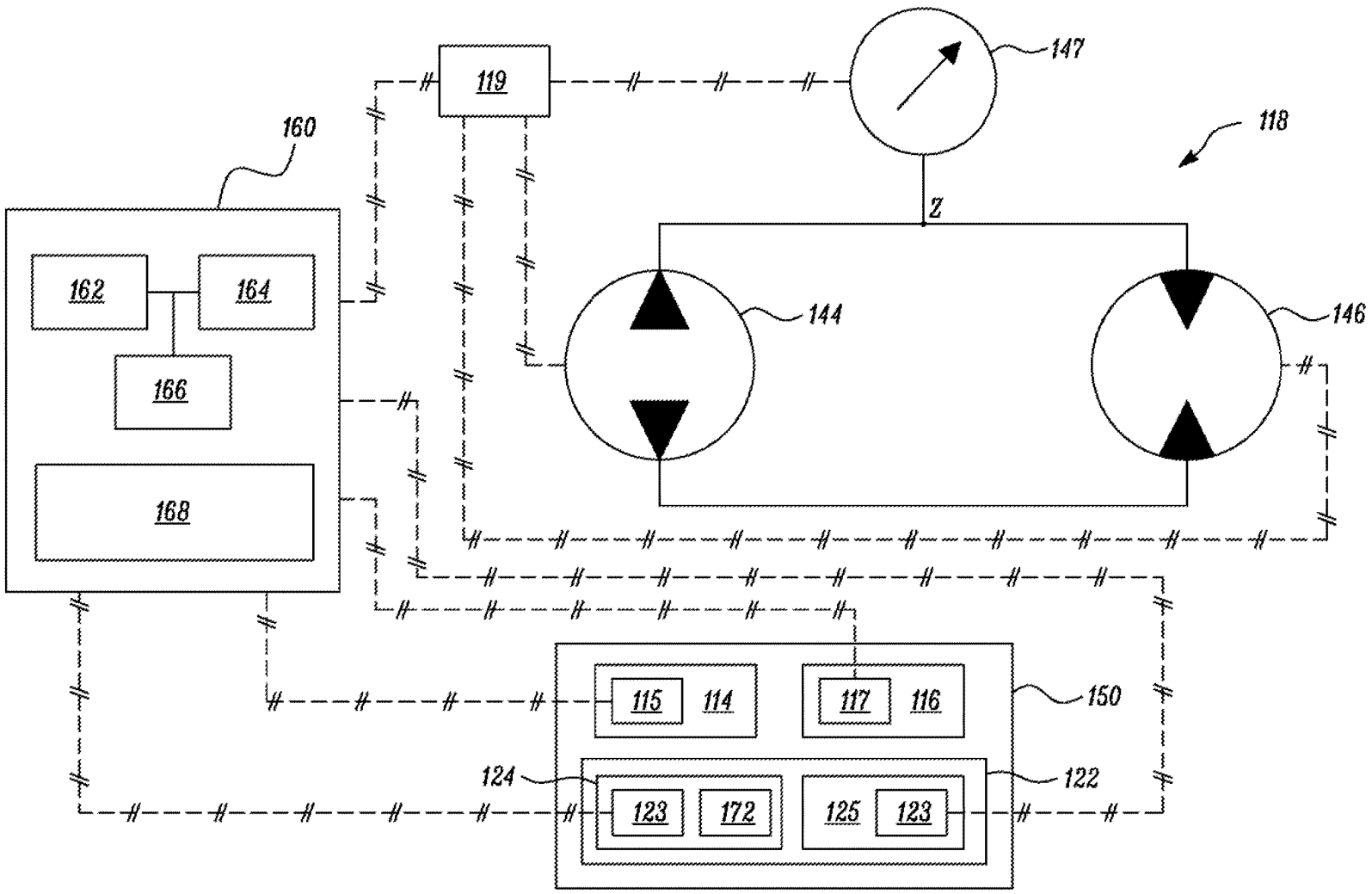
FIG. 5 illustrates a schematic of the one or more systems of the machine, in accordance with an alternate embodiment of the present disclosure.

In the embodiment illustrated in FIG. 4, a single controller 162 that directly operates/controls the swing system 118 and the plurality of systems 150 has been depicted. However, in an alternate embodiment as illustrated in FIG. 5, each system of the machine 100 may include a sub-controller configured to operate associated/corresponding system. For example, in the embodiment illustrated in FIG. 5, the swing system 118 may include a first sub-controller 119 configured to control the operation of the swing system 118. Further, each system of the plurality of systems 150 may also include its own sub-controller configured to control the operation of corresponding system. For example, the implement system 116 may include a second sub-controller 117 configured to control the operation of the implement system 116. Further, the propulsion system 114 may include a third sub-controller 115 configured to control the operation of the propulsion system 114. Furthermore, the one or more auxiliary systems 122 may include a one or more fourth sub-controllers 123 configured to control the operation of the one or more auxiliary systems 122.

In such a configuration, the controller 162 may be a master controller that is communicably coupled to the sub-controllers 115, 117, 119 and 123 and that transmits instructions/signals to the sub-controllers 115, 117, 119 and 123 to control the operation of the sub-controllers 115, 117, 119 and 123. The sub-controllers 115, 117, 119 and 123 may be similar to the controller 162 and may have the same components/circuitry.

The control system 160 further includes an inertial measurement unit 168 disposed on the upper carriage 104 configured to determine/generate data pertaining to a rotation of the upper carriage 104 of the machine 100 relative to the work surface 128 of the worksite 102. In some embodiments, the rotation may be a full rotation (i.e., 360 degree rotation) of the upper carriage 104 of the machine 100 relative to the work surface 128 of the worksite 102. In some embodiments, the rotation may be a partial rotation (i.e., rotation by an angle ranging between 1-359 degrees) of the upper carriage 104 of the machine 100 relative to the work surface 128 of the worksite 102. The inertial measurement unit 168 may be communicably coupled to the controller 162 and may include one or more of gyroscopes, accelerometers or any other such devices known in the art.

Based on the data pertaining to the rotation of the upper carriage 104 relative to the work surface 128, the controller 162 determines the rotation of the upper carriage 104 relative to the undercarriage 106. In some embodiments, the rotation may be a lull rotation (i.e., 360 degree rotation) of the upper carriage 104 relative to the undercarriage 106. In some embodiments, the rotation may be a partial rotation (i.e., rotation by an angle ranging between 1-359 degrees) of the upper carriage 104 relative to the undercarriage 106.

Subsequent to the determination of the data pertaining to the rotation of the upper carriage 104 relative to the undercarriage 106, the controller 162 executes a set of instructions on the received data pertaining to the rotation of the upper carriage 104 relative to the undercarriage 106, and determines a first amount of torque consumed by the swing system 118.

The determination of the first amount of torque may include executing a set of instructions, stored in the controller 162, on the data pertaining to the rotation of the upper carriage 104 relative the undercarriage 106 and on the data from the pressure measuring device 147. More specifically, the set of instructions may include computations that when implemented on the data pertaining to the rotation of the upper carriage 104 relative to the undercarriage 106 provide the rotational speed and/or displacement of the upper carriage 104 relative to the undercarriage 106. For example, the data pertaining to the rotation of the upper carriage 104 relative to the undercarriage 106 may include angular displacement data which is indicative of the angular displacement of the upper carriage 104 that takes place when the upper carriage 104 rotates relative to the undercarriage 106. Utilizing this angular displacement data of the upper carriage 104 relative to the undercarriage 106 along with the time taken during the rotation/angular motion of the upper-carriage 104 relative the undercarriage 106, the rotational speed of the upper carriage 104 relative to the undercarriage 106 is determined. For instance, in an exemplary scenario the upper carriage 104 may rotate by an angular displacement of 'ω' (in degrees, radians, or revolutions) relative to the undercarriage 106. For the upper carriage 104 to rotate by 'ω' relative to the undercarriage 106, a time 'T' (in seconds, minutes, hours) may be taken. The angular and/or rotational speed of the upper carriage 104 relative to the undercarriage 106 may be calculated by the equation:

Rotational speed=angular displacement/Time taken for the angular displacement to take place Or Rotational Speed='ω'/'*T*'

Further, the controller 162 and/or the memory 164 may have a pre-stored computation/instruction/equation (for example, rotational speed of swing motor 146=rotational speed of upper carriage 104 relative to undercarriage 106× gearing ratio$^{-1}$–the gearing ratio being the ratio of the teeth of gears, being utilized by the swing bearing assembly 108 to rotate the upper carriage 104, relative to the lower carriage 106). Using the pre-stored equations, the determined rotational speed and/or displacement of the upper carriage 104 relative to the undercarriage 106, the rotational speed and displacement of the swing motor 146 and the swing pump 144 are determined. Once the controller 162 determines the swing motor's 146 speed, the controller 162 runs computations/instructions/equations (pre-stored in the controller 162 and/or the memory 164) to determine the hydraulic fluid flow in the swing system 118. For example, the equations my be using the logic that one rotation per minute/second/hour of the swing pump 144 displaces and produces fluid flow equal to first volume of fluid per minute/second/hour, so M rotations per minute/second/hour would displace and produce fluid flow equal to M×first volume of fluid per minute/second/hour, where M corresponds to the rotational speed of the swing pump 144.

Using this determined hydraulic fluid flow in the swing system 118, swing motor's 146 speed and the pressure readings from the pressure measuring device 147, the controller 162 determines the first amount of torque consumed by the swing system 118. For example, to determine the first amount of torque the controller 162 may be configured to utilize the equation:

Torque=[Fluid flow Rate (fluid flow per unit time)× Pressure (force exerted per unit area)×Constant]/Rotations of the swing Motor 146 per unit time.

In one embodiment, fluid flow rate may be quantified in term of Gallons per minute, the pressure may be quantified as pound per inch and the rotational motion of the swing motor 146 may be quantified in rotations per minute. For such data the torque equation may be:

Torque=[Fluid flow Rate (e.g., in Gallons Per Minute)×Pressure (e.g., pound per square inch)× 36.77]/Rotations Per Minute of the swing motor.

Where "36.77" corresponds to the constant.

Although, the constant takes up a value of 36.77 in the embodiment being describer, in various other embodiments the value, of the constant may vary for different units of measurements for the fluid flow rate, swing motor's 146 speed and pressure value within the swing system 118.

A more detailed explanation of the calculation/determination of the first amount of torque will be discussed later in the specification with respect to exemplary scenarios.

The controller 162 then determines a total torque demand based on the first amount of torque. The total torque demand is the total amount of torque demanded by multiple operational systems and activated systems to perform the desired operation. The controller 162 is further configured to adjust the total torque demand when the total torque demand exceeds a maximum torque capacity of the power source 126 by controlling an amount of torque to be received, from the power source 126, by one or more systems of the plurality of systems 150.

INDUSTRIAL APPLICABILITY

As discussed above, the present disclosure relates to the control system 160 having the inertial measurement unit 168 configured to determine/generate data pertaining to the rotation of the upper carriage 104 of the machine 100 relative to the work surface 128 of the worksite 102. Utilizing such generated/determined data, the controller 162 of the control system 160 may determine the torque consumed by the swing system 118. The controller 162 is further configured to monitor the torque demands of each system of the machine 100 and adjust the total torque demand. Such control systems accurately measure magnitude of torque consumed by the swing system 118 and assist in effective utilization of available torque thereby improving the efficiency of the machine 100 and the total work output of the machine 100.

Figure 6:
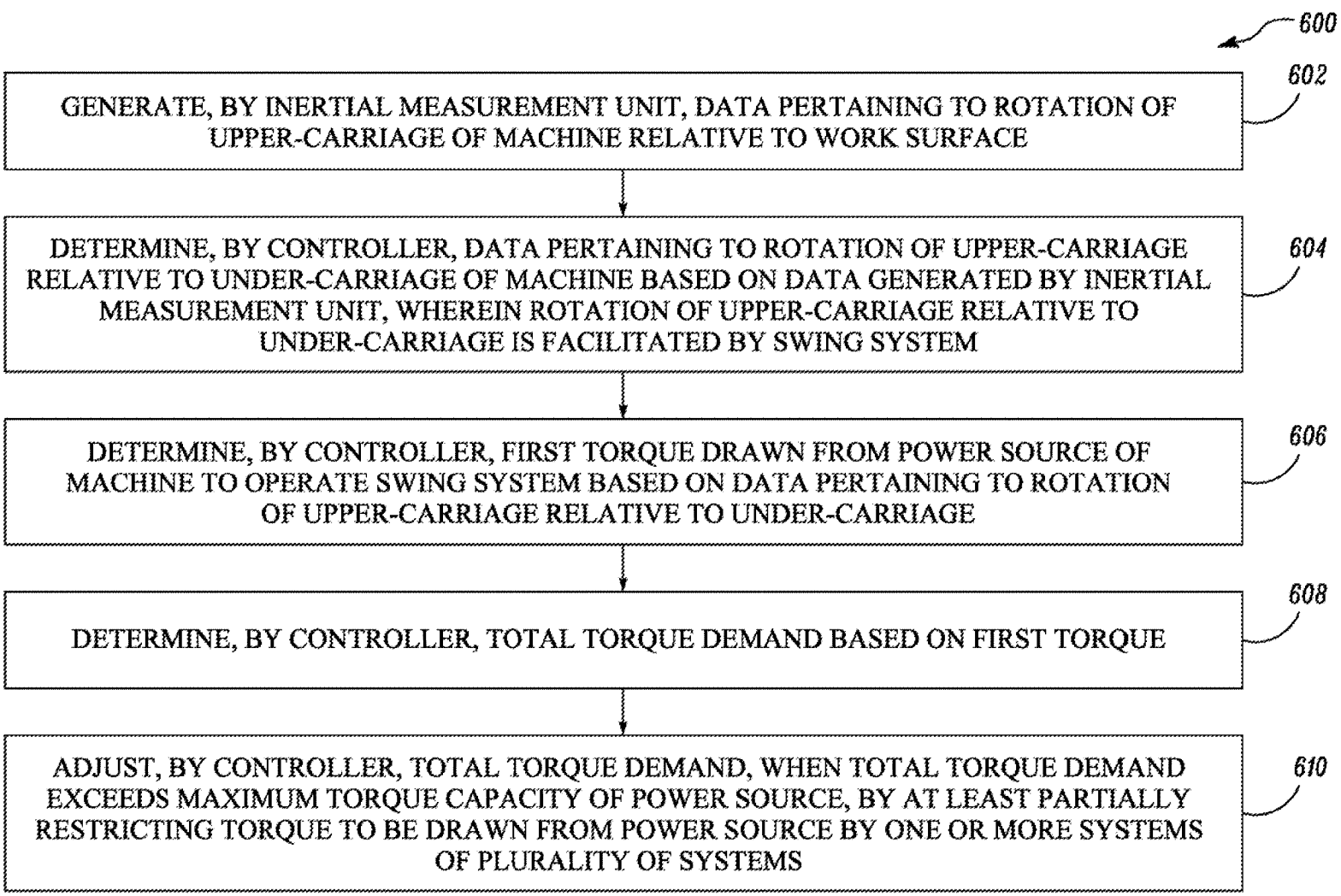
FIG. 6 depicts a method for controlling the machine in accordance with an embodiment of the present disclosure.

In another aspect of the present disclosure, a method 600 for controlling the machine 100 using the control system 160 is disclosed as shown in FIG. 6. The method 600 includes generating, by the inertial measurement unit 168, the data pertaining to the rotation of the upper carriage 104 of the machine 100 relative to the work surface 128 of the worksite 102 (Step 602). The method 600 further includes determining, by the controller 162, the data pertaining to the rotation of the upper carriage 104 relative to the undercarriage 106 of the machine 100 based on the generated data (i.e., the data pertaining to the rotation of the upper carriage 104 of the machine 100 relative to the work surface 128 of the worksite 102) (Step 604). The method 600 further includes determining, by the controller 162, the first amount of torque (in the manner as discussed above and disclosed later in further detail) consumed by the swing system 118 (i.e., first amount of torque received by swing system 118 from the power source 126). The amount of torque is determined based on the data pertaining to the rotation of the upper carriage 104 relative to the undercarriage 106, as disclosed above (Step 606).

Furthermore, the method 600 includes determination, by the controller 162, of a total torque demand based on the first amount of torque (Step 608). The method 600 then includes the controller 162 adjusting the total torque demand, when the total torque demand exceeds the maximum torque capacity of the power source 126, by reducing the amount of torque to be received from the power source 126 by one or more systems of the plurality of systems 150 (Step 610).

The abovementioned method 600 and the operation of the controller 162 and the inertial measurement unit 168 will now be explained in detail with reference to FIG. 1 to FIG. 5 and multiple exemplary scenarios.

In an exemplary scenario, it may be assumed that the power source 126 of the machine 100 has the capability of generating a maximum torque of magnitude 200 Newton× Meter (hereinafter Newton×Meter shall be referred as 'Nm'). Further, it may be assumed that an operator stationed in the operator cab 110 is operating the machine 100 to perform a desired work operation at the worksite 102. During such operation, the machine 100 may be using one or more systems of the plurality of systems 150 and the swing system 118. The operator in the operator cab 110 may have actuated the swing system 118 by moving a lever, joystick/toggle-stick or pressing buttons present in the operator cab 110. Accordingly, the swing system 118 may receive some amount of torque from the power source 126 to perform a rotation of the upper carriage 104 relative to the undercarriage 106, as desired by the operator. Additionally, the operator may have instructed the machine 100 to move such that the undercarriage 106 may be rotating and/or revolving relative to the work surface 128 of the worksite 102.

When the swing system. 118 rotates the upper carriage 104 relative to the undercarriage 106 and machine moves in the manner as described above, the inertial measurement unit 168 disposed on the upper carriage 104 detects that the upper carriage 104 has moved rotationally relative to the work surface 128. The detection of such motion of the upper carriage 104 and the undercarriage 106 triggers the inertial measurement unit 168 to generate the data pertaining to rotation of the upper carriage 104 relative to the work surface 128. In an embodiment, the generation of the data pertaining to the rotation of the upper carriage 104 relative to the work surface 128 may include recording angular displacement, angular orientation, angular speed of upper carriage 104 relative to the work surface 128 at various time instants during the rotation of the upper carriage 104.

The data pertaining to the rotation of the upper carriage 104 relative to the work surface 128 may include the data pertaining to the rotation of the upper carriage 104 relative to the undercarriage 106 caused by the swing system 118. Further, the data pertaining to the rotation of the upper carriage 104 relative to the work surface 128 may also include data pertaining to the rotation of the upper carriage 104 caused by the rotational/revolutionary movement of the undercarriage 106 relative to the work surface 128 (for example, if the undercarriage 106 is rotating/revolving relative to the ground surface 128, it will cause the upper carriage 104 to rotate as well. Such rotational movement may be detected by the inertial measurement unit 168 and the data regarding such rotation may be generated).

The controller 162 may be constantly tracking the motion of the undercarriage 106 relative to the work surface 128. For example, in an embodiment, the controller 162 may be configured to track the path traversed by the machine 100 via a GPS (Global Positioning System). The controller 162 may further be configured to detect the orientation of the undercarriage 106 of the machine 100 relative to the work surface 128 throughout the movement of the machine 100 (i.e., throughout traversal of the machine 100 on the path). Based on such tracking, the master controller 162 may be able to determine the rotational and/or revolutionary movement of the undercarriage 106 of the machine 100 relative to the work surface 128.

Using this determined data (i.e., data about the rotational and/or revolutionary movement of the undercarriage 106 of the machine 100 relative to the work surface 128) and the data pertaining to the rotational movement of the upper carriage 104 of the machine 100 relative to the work surface 128, the controller 162 determines the data pertaining to the rotation to the upper carriage 104 relative to the undercarriage 106. In an embodiment, the data pertaining to the rotation to the upper carriage 104 relative to the undercarriage 106 may include angular speed, angular displacement and angular orientation of the upper carriage 104 relative to the undercarriage 106.

After determining the data pertaining to the rotation to the upper carriage 104 relative to the undercarriage 106, the controller 162 transmits a signal to the pressure measuring device 147. The signal directs the pressure measuring device 147 to send the pressure values at various locations in the swing system 118. After receiving the pressure values at various locations in the swing system 118 from the pressure measuring device 147, the controller 162 determines the first amount of torque consumed by the swing system 118 to perform the rotation of the upper carriage 104 relative to the undercarriage 106.

As disclosed above, the determination of the first amount of torque may include executing a set of instructions, stored in the controller 162, on the data pertaining to the rotation of the upper carriage 104 relative the undercarriage 106 and on the data from the pressure measuring device 147. More specifically, the set of instructions may include computations that when implemented on the data pertaining to the rotation of the upper carriage 104 relative the undercarriage 106 provide the rotational speed and/or displacement of the upper carriage 104 relative to the undercarriage 106. The set of instructions may further include computations that determine hydraulic fluid flow in the swing system 118, based on the determined rotational speed of the upper carriage 104 relative to the undercarriage 106.

The explanation of how swing system 118 works and how the controller 162 determines the fluid flow in the swing system 118 will now be explained in detail. The swing pump 144 receives torque from the power source 126 and rotates to pressurize and displace a fixed volume of fluid (this information may be stored in the memory 164). The displaced and pressurized fluid is passed through the swing motor 146 to impart rotational speed and displacement to the swing motor 146. The swing motor 146 may be coupled to the upper carriage 104 by a gearing assembly (not shown) having a gearing ratio (ratio of the number of teeth in the driving gear (i.e., gear being rotated by the swing motor 146 to the number of teeth in the driven gear (i.e., gear of the swing bearing assembly 108)). The rotational speed and displacement of the swing motor 146 is reduced (because of the gearing ratio of the gearing assembly) and transferred to the upper carriage 104 by the gearing assembly, to rotate the upper carriage 104 relative to the undercarriage 106. Such knowledge about the working of the swing system 118 may be pre-stored in the memory 164 and/or controller 162.

Further, the controller 162 and/or the memory 164 may have a pre-stored computation/instruction/equation (for example, rotational speed of swing motor 146=rotational speed of upper carriage 104 relative to undercarriage 106× gearing ratio$^{-1}$) that utilize gearing ratio of the gear assembly, the determined rotational speed and/or displacement of the upper carriage 104 relative to the undercarriage 106 to determine the rotational speed and displacement of the swing motor 146 and the swing pump 144. Once the controller 162 determines the swing motor's 146 speed, the controller 162 runs computations/instructions/equations (pre-stored in the controller 162 and/or the memory 164) to determine the hydraulic fluid flow in the swing system 118. For example, the equations may be using the logic that one rotation per minute/second/hour of the swing pump 144 displaces and produces fluid flow equal to first volume of fluid per minute/second/hour, so M rotations per minute/second/hour would displace and produce fluid flow equal to M×first volume of fluid per minute/second/hour, where M corresponds to the rotational speed of the swing pump 144.

Using this determined hydraulic fluid flow in the swing system 118, swing motor's 146 speed and the pressure readings from the from the pressure measuring device 147, the controller 162 determines the first amount of torque consumed by the swing system 118. For example, to determine the first mount of torque, the controller 162 may be configured to utilize the equation:

Torque=[Fluid flow Rate (fluid flow per unit time)× Pressure (force exerted per unit area)×Constant]/Rotations of the swing motor 146 per unit time For the purpose of better understanding let it be assumed that the controller 162 determines that the magnitude of the first amount of torque received from the power source 126, by the swing system 118 is 100 Nm.

Simultaneously, the controller 162 determines parasitic loads (i.e., loads that are uncontrollable and loads that can be merely modeled or estimated). The parasitic loads may include loads/torques consumed by alternator, hydraulic charge pumps, pilot pumps, some machine cooling functions. For the purpose of better understanding let it be assumed that the controller 162 estimates that the magnitude of the torque received from the power source 126 by the parasitic loads is 20 Nm.

The controller 162 may also simultaneously detect one or more active systems of the plurality of systems 150. For example, it may be assumed that in the exemplary scenario the controller 162 detects that the implement system 116 and a first system 124 of the one or more auxiliary systems 122 are the active systems (active systems refer to the systems that are in running/active state). The controller 162 receives data pertaining to the one or more active systems of the plurality of systems 150 from various sensors placed on the one or more active systems. For example, the controller 162 may receive data pertaining to the implement system 116 from a sensor 170 (disposed on the implement system 116) that is configured to detect and transmit data pertaining to one or more characteristics of the implement system 116. The one or more characteristics may include pump speed of the implement pump 140, flow of fluid through the implement system 116 and pressure of fluid being circulated within the implement system 116. Similarly, the controller 162 may be configured to receive data pertaining to the first system 124 via a sensor 172 disposed on the first system 124. Based on the data pertaining to the one or more active systems (i.e., the implement system 116 and a first system 124 of the one or more auxiliary systems 122), the controller 162 determines a second amount of torque received by the one or more active systems from the power source 126. Let it be assumed that the controller 162 determines that magnitude of torque consumed by implement system 116 is 40 Nm and magnitude of torque consumed by first system 124 is 20 Nm (the controller 162 thus determines that the second amount of torque is 60 Nm).

In the current exemplary scenario described herein the machine 100 machine 100 includes the power source that can produce maximum of 200 Nm torque. Further, the machine 100 has systems that are active or are in operational state. These systems consume a total of 180 Nm (i.e., 100 Nm (swing system 118), 20 Nm (parasitic loads), 20 Nm (first system 124) and 40 Nm (implement system 116)). In such a working scenario of the machine 100, the operator stationed in the operator cab 110 may request additional torque demand of 40 Nm for the implement system 116. In such a scenario the sum of the first amount of torque, the second amount of torque, magnitude of torque consumed by parasitic loads and the additional torque demand far an operational/active system will come out to be 220 Nm. If such a value that exceeds the maximum torque the power source 126 can produce is demanded from the power source 126, then the power source 126 may stall. To prevent such a situation, the controller 162 adjusts the total torque demanded by reducing the amount of torque to be received from the power source 126 by one or more systems of the plurality of systems 150. For example, in an embodiment, the controller 162 may only transmit the 20 Nm torque to the implement system 116 and may also inform the implement system 116 that the desired torque is not available. In an alternate embodiment, the controller 162 may cease (i.e., stop) the torque transmission of 20 Nm to the first system 124 and may then transmit the available torque of 40 Nm to the implement system 116.

In an alternate embodiment, the machine 100 includes the power source that can produce maximum of 200 Nm torque. Further, the machine 100 has systems that are active or in operational state. These systems consume a total of 180 Nm (i.e., 100 Nm (swing system 118), 20 Nm (parasitic loads), 20 Nm (first system 124) and 40 Nm (implement system 116)). The operator may now request activation of one or more inactive systems of the plurality of systems 150 to perform a desired operation. The controller 162 may determine the third amount of torque that would be demanded by one or more inactive systems when a request to actuate one or more inactive system of the plurality of systems 150 would be generated. For example, let us assume that the operator stationed in the operator cab 110 requests activation of a second system 125 of the one or more auxiliary systems 122 (a system that is in art inactive system). The controller 162 determines an amount of torque that would be required to run the second system 125 by looking up the value of torque in a torque table pre-stored within the memory 164 (the torque table being the table having the value of torque consumed by each system of the machine 100 in response to the request generated by the operator). Let us assume that the third amount of torque demand is determined as 40 Nm.

The controller 112 now determines the total torque demand of the machine 100 by computing the sum of the first amount of torque, second amount of torque, magnitude of torque consumed by parasitic loads and third amount of torque. This total torque value is then demanded from the power source 126. In the exemplary scenario the sum of the first amount of torque, the second amount of torque and the third amount of torque will come out to be 220 Nm. If such a value that exceeds the maximum torque the power source 126 can produce is demanded from the power source 126, then the power source 126 may stall. To prevent such a situation, the controller 162 adjusts the total torque demand by reducing the amount of torque to be received from the power source 126 by or more systems of the plurality of systems 150.

For example, in the current scenario the controller 162 detects that the total torque demand of 220 Nm is more than the maximum torque of 200 Nm that can be generated by the power source 126. In an example, the controller 162 may adjust the value of the total torque demand by reducing 20 Nm to one system of the plurality of systems 150 (for example, the controller 162 may reduce the magnitude of torque supplied to the implement system 116 by 20 Nm. In such a scenario the implement system 116 still operates however functions at a lower energy than is desired). In an alternate example, the controller 162 may reduce the magnitude of torque supplied to each of the active and recently activated system by a predetermined value to ensure that the total torque supplied to such systems does not exceed the maximum torque that can be generated by the power source 126. For example, the controller 162 may reduce the torque demanded each of the implement system 116, the first system 124 and the second system 125 by 10 Nm. With such adjustments, the systems function at a lower energy but stalling of the power source 126 is prevented. In yet another example, the controller 162 may decide not to transmit torque to the one or more inactive system that were requested to be activated in order to prevent the power source 126 from stalling.

In yet another example, the controller 162 may terminate (i.e., stop) the amount of torque being supplied to one or more systems of the plurality of systems such that the total torque demand is either equal to or less than the maximum torque capacity of the power source 126. For example, the controller 162 may determine that the first system 124 could be shut down (torque transmission to the first system 124 could be stopped) to prevent the power source 126 from stalling. In such a scenario, the controller 162 may opt to terminate the amount of torque being supplied to the first system 124 to prevent the power source 126 from stalling. terminate Generally in the machine 100 as disclosed in the present disclosure, the swinging motion of the upper carriage 104 relative to the undercarriage 106 that is performed by the swing system 118 may consist of segments of time during which swing motor 146 is accelerating a swinging movement of the implement system 116, and segments of time during which swing motor 146 is decelerating the swinging movement of implement system 116. The acceleration segments may require significant energy from swing motor 146 realized by way of pressurized fluid supplied to swing motor 146 by the swing pump 144. During the deceleration segments, the rotational momentum/rotational speed of the upper carriage 104 relative to the undercarriage 106 is utilized to produce significant energy in the form of pressurized fluid having kinetic energy. Such energy may be recovered in the form of torque by use of motors/accumulators or other such energy converting devices known in the art. For example, the pressurized fluid may be forced to flow through a recovery pump/motor and generate a regenerative torque. On such an exemplary regenerative setup, one or more sensors may be present that may be configured to detect the fluid flow, the kinetic energy of the pressurized fluid and the like. Based on these detected parameters, the controller 162 may be configured to determine the regenerative torque produced by the swing system 118.

The controller 162 may then include the recovered/regenerative torque as one of the parameters during, computation of the total torque demand. This may help in effective utilization of torque available for use. For example, in the exemplary scenario illustrated above it is known that the swing system 118 consumed 100 Nm, the implement system 116 and the first system 124 consume 60 Nm and the recently activated inactive system (i.e., the second system 125 demands torque of 40 Nm).

In an exemplary scenario, let us assume that swing system 118 recovers some energy in the form of regenerative torque. Let the value of the regenerative torque be assumed as 15 Nm. The controller 162 may determine the magnitude of the recovered torque as 15 Nm (using the determination procedure discussed above) and may include this value to compute/modify/update the total torque demand. In this situation, the total torque demand will come out as 205 Nm (=100−15+80+40). In such a scenario, the controller 162 only has to adjust the total torque value by 5 Nm and not by 20 Nm as in the example presented earlier above). Thus, detecting the regenerative torque and including the regenerative torque as a parameter to compute the total torque demand prevents wastage of torque and enhances productivity of the machine 100.

The method 600 and the control system 160 as described in the present disclosure help in accurate determination of the torque consumed by the swing system 118. Such accurate determinations enable the control system 160 to accurately determine a total torque demand, a scenario that leads to efficient operation of the machine 100. Further, due to the accurate torque determination, the condition when the total torque demand exceeds the maximum torque that can be generated by the power source 126 can be detected. Subsequent to detection of such a condition, controller 162 operates such that stalling of the power source 126 is prevented. Such control systems and methods, thus, enhance the productivity and prevent shutdown/downtime of the machine due to stalling conditions.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof. No element/component, act/action performed by any element/component, or instruction used herein should be construed as critical or essential unless explicitly described as such. Additionally, the phrase "based on" is intended to mean "based, at least in part, on" unless explicitly stated otherwise. Furthermore, the articles "a" and "an," as used herein, are intended to include one or more items, and may be used interchangeably with "one or more." In the event only one item is intended, the term "one" or similar language is used. Moreover, the terms "has," "have," "having," or the like, as also used herein, are intended to be open-ended terms.

What is claimed is:

1. A method for controlling a machine, the machine including a swing system and a plurality of systems, the method comprising:

generating, by an inertial measurement unit, data pertaining to a rotation of an upper carriage of the machine relative to a work surface;

determining, by a controller, data pertaining to a rotation of the upper carriage relative to an undercarriage of the machine based on the data generated by the inertial measurement unit, wherein the swing system performs the rotation of the upper carriage relative to the undercarriage;

determining, by the controller, an amount of torque consumed by the swing system, the amount of torque being received by the swing system from a power source of the machine, wherein the amount of torque is determined based on the data pertaining to the rotation of the upper carriage relative to the undercarriage;

determining, by the controller, a total torque demand based on the amount of torque; and adjusting, by the controller, the total torque demand when the total torque demand exceeds a maximum torque capacity of the power source, wherein adjusting the total torque demand includes reducing a particular amount of torque to be received, from the power source, by one or more systems of the plurality of systems; and;

wherein determining the total torque demand includes:

determining, by the controller, a second amount of torque received, from the power source, by one or more active systems of the plurality of systems;

determining, by the controller, a third amount of torque required to operate one or more inactive systems of the plurality of systems when a request to activate the one or more inactive systems is received; and determining, by the controller, the total torque demand based on the first amount of torque, the second amount of torque and the third amount of torque.

2. The method of claim 1, wherein the data pertaining to the rotation of the upper carriage relative to the undercarriage includes a magnitude of at least one of an angular displacement of the upper carriage relative to the undercarriage or an angular speed of the rotation of the upper carriage relative to the undercarriage.

3. The method of claim 1, wherein the amount of torque is a first amount of torque, and wherein determining the total torque demand includes:

determining, by the controller, a second amount of torque received, from the power source, by one or more active systems of the plurality of systems;

determining, by the controller, an additional torque demand requested by at least one system of the one or more active systems of the plurality of systems; and determining, by the controller, the total torque demand based on the first amount of torque, the second amount of torque and the additional torque demand.

4. The method of claim 1 wherein, the power source is one of an electric motor or an engine, and inertial measurement unit includes one or more of gyroscopes or accelerometers.

5. The method of claim 1 further comprising determining, by the controller, a regenerative torque generated by the swing system.

6. The method of claim 5 further comprising:

modifying, by the controller, the total torque demand based on the regenerative torque generated by the swing system.

7. A control system for controlling a swing system and a plurality of systems operatively coupled to a power source of a machine, the control system comprising:

an inertial measurement unit configured to generate data pertaining to a rotation of an upper carriage of the machine relative to a work surface; and a controller communicably coupled to the swing system, the plurality of systems and the inertial measurement unit, the controller configured to:

determine data pertaining to a rotation of the upper carriage relative to an undercarriage of the machine based on the data generated by the inertial measurement unit, wherein the swing system performs rotation of the upper carriage relative to the undercarriage;

determine an amount of torque consumed by the swing system, the amount of torque being received by the swing system from the power source, wherein the amount of torque is determined based on the data pertaining to the rotation of the upper carriage relative to the undercarriage;

determine a total torque demand based on the amount of torque; and adjust the total torque demand, when the total torque demand exceeds a maximum torque capacity of the power source, wherein adjusting the total torque demand includes reducing a particular amount of torque to be received from the power source by one or more systems of the plurality of systems; and;

wherein determining the total torque demand includes:

determine a second amount of torque received, from the power source, by one or more active systems of the plurality of systems;

determine a third amount of torque required to operate one or more inactive systems of the plurality of systems when a request to activate the one or more inactive systems is received; and determine the total torque demand based on the first amount of torque, the second amount of torque and the third amount of torque.

8. The control system of claim 7 wherein the controller is configured to cease transmission of the particular amount of torque from the power source to the one or more systems of the plurality of systems.

9. The control system of claim 7 wherein, the inertial measurement unit includes one or more of gyroscopes or accelerometers for generating the data pertaining to the rotation of the upper carriage relative to the undercarriage, and the power source is one of an engine or an electric motor.

10. The control system of claim 7 wherein, the data pertaining to the rotation of the upper carriage relative to the undercarriage includes a magnitude of at least one of an angular displacement of the upper carriage relative to the undercarriage or an angular speed of the rotation of the upper carriage relative to the undercarriage.

11. The control system of claim 7 wherein the amount of torque is a first amount of torque, and wherein the controller is further configured to:

determine a second amount of torque received, from the power source, by one or more active systems of the plurality of systems;

determine an additional torque demand requested by at least one system of the one or more active systems of the plurality of systems; and determine the total torque demand based on the first amount of torque, the second amount of torque and the additional torque demand.

12. The control system of claim 7 wherein the controller is further configured to:

determine a regenerative torque generated by the swing system; and modify the total torque demand based on the regenerative torque generated by the swing system.

13. A machine comprising:

a power source;

an undercarriage;

an upper carriage rotatably mounted on the undercarriage;

a plurality of systems and a swing system operatively coupled to the power source, the swing system configured to rotate the upper carriage relative to the undercarriage;

an inertial measurement unit configured to generate data pertaining to a rotation of the upper carriage of the machine relative to a work surface; and a controller communicably coupled to the swing system, the plurality of systems and the inertial measurement unit, the controller configured to:

determine data pertaining to a rotation of the upper carriage relative to the undercarriage of the machine based on the data generated by the inertial measurement unit;

determine an amount of torque consumed by the swing system, the amount of torque being received by the swing system from the power source, wherein the amount of torque is determined based on the data pertaining to the rotation of the upper carriage relative to the undercarriage;

determine a total torque demand based on the amount of torque; and adjust the total torque demand, when the total torque demand exceeds a maximum torque capacity of the power source, wherein adjusting the total torque demand includes reducing a particular amount of torque to be received from the power source by one or more systems of the plurality of systems; and;

wherein determining the total torque demand includes:

determine a second amount of torque received, from the power source, by one or more active systems of the plurality of systems;

determine a third amount of torque required to operate one or more inactive systems of the plurality of systems when a request to activate the one or more inactive systems is received; and determine the total torque demand based on the first amount of torque, the second amount of torque and the third amount of torque.

14. The machine of claim 13 wherein the controller is further configured to cease transmission of the particular amount of torque from the power source to the one or more systems of the plurality of systems.

15. The machine of claim 13 wherein the data pertaining to the rotation of the upper carriage relative to the undercarriage includes a magnitude of at least one of an angular displacement of the upper carriage relative to the undercarriage or an angular speed of the rotation of the upper carriage relative to the undercarriage.

16. The machine of claim 13 wherein the amount of torque is a first amount of torque, and wherein the controller is further configured to:

determine a second amount of torque received, from the power source, by one or more active systems of the plurality of systems;

determine an additional torque demand requested by the one or more active systems of the plurality of systems; and determine the total torque demand based on the first amount of torque, the second amount of torque and the additional torque demand.

17. The machine of claim 13 wherein the controller is further configured to:

determine a regenerative torque generated by the swing system; and updating the total torque demand based on the regenerative torque generated by the swing system.

* * * * *